United States Patent [19]

Malik et al.

[11] Patent Number: 5,014,944

[45] Date of Patent: May 14, 1991

[54] WIRE HOLDER FOR PLASTIC BAG FOR TRASH

[76] Inventors: James J. Malik, 6618 Bennington Dr., Parma Heights, Ohio 44130; George J. Theodore, 16541 Timberline Dr., Strongsville, Ohio 44136

[21] Appl. No.: 718,636

[22] Filed: Apr. 1, 1985

[51] Int. Cl.[5] ..... B65B 67/00

[52] U.S. Cl. ..... 248/99; 248/156; 248/97

[58] Field of Search ..... 248/99, 98, 97, 95, 248/100, 101, 156; 220/6, 404; 100/51; 141/390, 391; 53/390, 384

[56] References Cited

U.S. PATENT DOCUMENTS

| | | | |
|---|---|---|---|
| D. 216,438 | 1/1970 | Gay et al. | 248/97 X |
| 477,686 | 3/1891 | Holladay | 248/100 X |
| 972,870 | 10/1910 | Kandlbinder | 248/99 |
| 2,399,498 | 4/1946 | Messick | 248/156 X |
| 2,491,515 | 12/1949 | Orchard | 248/99 |
| 2,556,124 | 6/1951 | Ullrich | 248/156 X |
| 2,894,708 | 7/1959 | Kaplan | 248/99 |
| 3,638,888 | 2/1972 | Ross | 248/97 |
| 3,796,402 | 3/1974 | Trotta | 248/101 X |
| 4,467,989 | 8/1984 | Stroh | 248/99 X |

FOREIGN PATENT DOCUMENTS

| | | | |
|---|---|---|---|
| 124586 | 3/1910 | Canada . | |
| 2325605 | 12/1974 | Fed. Rep. of Germany | 248/97 |

*Primary Examiner*—Karen J. Chotkowski

*Attorney, Agent, or Firm*—Woodling, Krost & Rust

[57] ABSTRACT

A foldable wire holder for a plastic bag is disclosed to hold the bag in a vertical position with its mouth snagged in a fully open position on a wire framework formed by a horizontally disposed bag holding frame and an upper portion of an upright supporting framework for the bag holding frame. The wire holder is portable and, in one embodiment, may simply be thrust into the ground where it is to be used, for example, to collect leaves, grass clippings, or other discrete matter. The legs of the supporting frame are provided with stub ends and a lateral support member which sets their depth and keeps the bag holding frame in a horizontal plane while the bag is filled. In another embodiment, a foldable base is provided which is a mirror image of the bag holding frame. Angulation of pivot means on the supporting frame, or of the ends of the bag holding frame, is essential to position the bag holding frame in the horizontal position.

2 Claims, 4 Drawing Sheets

WIRE HOLDER FOR PLASTIC BAG FOR TRASH

BACKGROUND OF THE INVENTION

This invention relates to a device made from wire for the specific purpose of bagging leaves or other organic matter, discrete material or trash of the nature which is generally bagged in large plastic bags for transporting the material, or for its disposal.

More particularly this invention relates to a portable wire holder for plastic bags which do not have integral handle-loops such as are in conventional use for transporting groceries and other articles. The large bags which are generally used for bagging leaves are made from thin synthetic resinous films less than about 2 mils thick, and commonly less than 1 mil thick. Because the bags are provided without handle-loops it is inconvenient for a person to single-handedly hold the mouth of the bag open and fill the bag simultaneously. Anyone who has stuffed a large plastic bag with leaves will recognize that it is a much easier task if another person holds the bag wide open.

There is some debate as to whether local ordinances which require that leaves and trash be bagged in plastic bags were promulgated to create a market for polyolefin film, or whether the availability of the bags made from such film incited the legislation. The fact is that using the bags efficiently without the assistance of another person is not easy.

Of course such inconvenience was not limited to plastic bags. Some three score years ago, the problem of holding a bag open so as to enable a person to bag material, was solved by using spring actuated hooks which were inserted into the bag to be held open, at the upper corners thereof. The device disclosed in U.S. Pat. No. 1,542,164 would serve quite adequately to hold a plastic bag open, except that it would be necessary to fix the locations of all four hooks if the upper frame were to be made from metal wire.

More recently, U.S. Pat. No. 3,638,888 discloses a leaf bag holder made from wire which is portable, and foldable so that it can be shipped and stored conveniently. Most important was the realization that the large plastic bag in general use were of standard size which made it possible to provide a frame of fixed dimensions upon which the bag could be snagged near its upper corners, doing away with the necessity for hooks and at the same time permitting the bag, when filled, to be removed by a forward lateral force, without lifting the bag.

Numerous other efforts have been made, with qualified success, to solve the problem elegantly and economically over the intervening period between the foregoing references. For example, U.S. Pat. No. 2,470,977 teaches a collapsible frame, but the filled bag must be lifted out of it. U.S. Pat. No. 3,796,402 teaches a dismantlable arcuate wire frame which requires clips which hold the bag to the bag holding frame. A similar wire frame, without the hooks, serves as the base.

Even a casual study of the prior art devices quickly forces one to the realization that a successful device must necessarily be extremely simple, portable, easy to package, use and store, at so low a price as to make its cost to the prospective purchaser, inconsequential. The wire bag holder of my invention fulfills the foregoing criteria.

SUMMARY OF THE INVENTION

A wire device is provided for a large plastic bag which has no handle-loops, to enable a person to fill the bag with leaves, other organic matter, or debris of any kind, without the aid of another person, while maintaining the bag in an upright position. The wire device consists of only two frame members, a bag holding frame and a supporting frame, the former rotatably disposed about a horizontal axis through the common attachment points of the frames. For use, the supporting frame is inserted into the earth and the bag holding frame is rotated from a vertical position to a horizontal position through an arc of about 270°.

The precise shape of the bag holding frame is not critical provided its peripheral length matches the periphery of the mouth of the bag to enable the bag to be snagged on the bag holding frame without the use of clips.

BRIEF DESCRIPTION OF THE DRAWINGS

The foregoing and other objects and advantages of our invention will appear more fully from the following description, made in connection with the accompanying drawings of preferred embodiments of the invention, wherein like reference characters refer to the same or similar parts throughout the several views and in which.

DETAILED DESCRIPTION OF PREFERRED EMBODIMENTS

Figure 1:
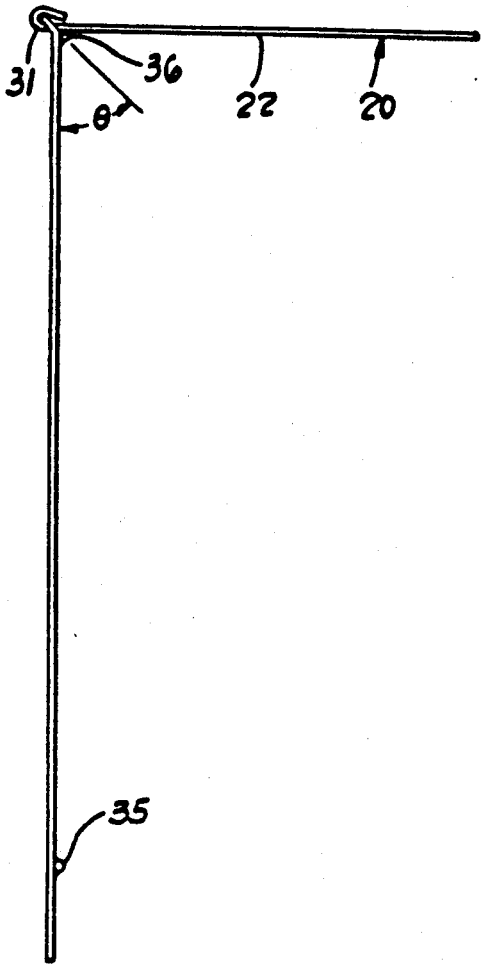
FIG. 1 is a side elevational view of the device in an upright position showing a vertical supporting frame and a bag holding frame supported in a horizontal position ready to receive a plastic bag.

In all embodiments of this invention, the device, indicated generally by reference numeral 10, is formed entirely from wire which is bent or otherwise deformed to serve desired mechanical functions. The wire is typically galvanized steel wire though any metal with adequate strength, such as aluminum, copper or conventional alloys, may be used. The shape of the cross-section of the wire is not narrowly critical and it may be rectangular, elliptical or circular, the latter being most commonly available and most preferred. The diameter of the wire is preferably as small as will give adequate strength for its intended service, most generally as a leaf bag holder, and as will make it so inexpensive that its cost is inconsequential.

For use as a leaf bag holder, the device 10 comprises a bag holding frame 20 and a supporting frame 30. The diameter of the wire is preferably in the range from about 0.125 inch to about 0.25 inch, the larger diameter being selected for heavy duty use.

Figure 2:
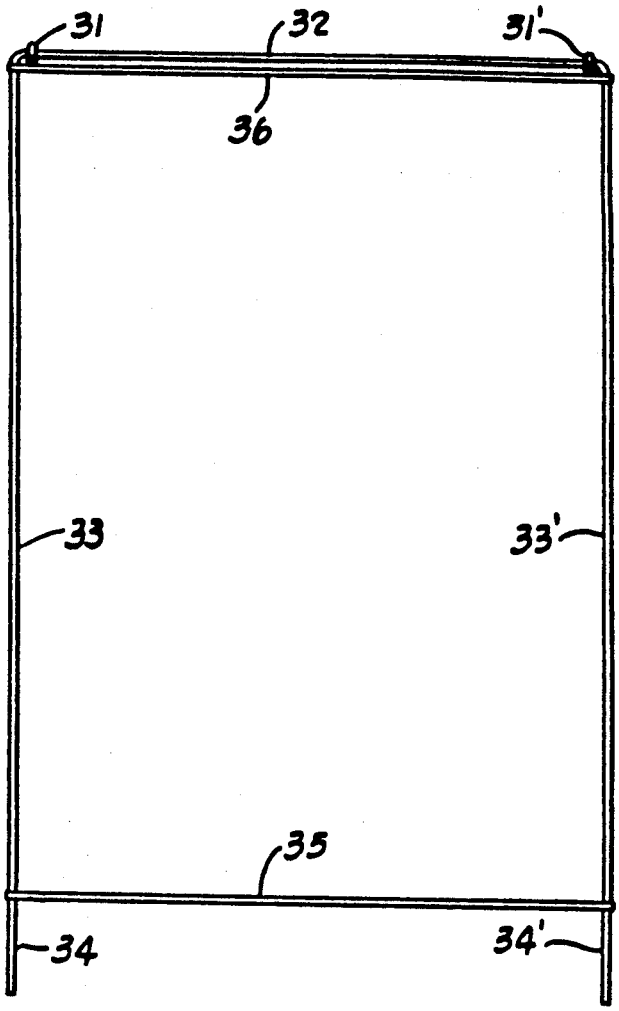
FIG. 2 is a front elevational view of the device in the upright position shown in FIG. 1.
Figure 3:
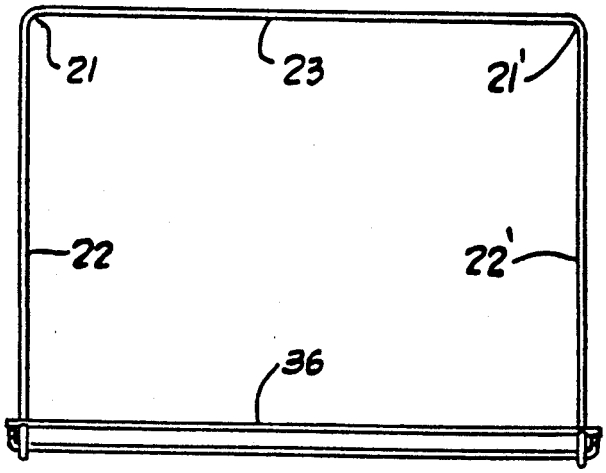
FIG. 3 is a bottom plan view of the device shown in the upright position shown in FIG. 2.

The bag holding frame 20 is formed from a single continuous length of wire bent into a U shape, the corners 21 and 21' at the bottom of the U being right angles, as seen in the bottom plan view shown in FIG. 3. Each end of opposed parallel sides 22 and 22' of the U-shaped holding frame 20 is bent back on itself, as seen in FIG. 1, to form eye means exemplified by wrap-around ends 31 and 31' wrapped around uppermost member 32 shown in FIG. 2. The shape of the holding frame 20 is not critical, as will be illustrated hereinafter, but it is essential that the eye means of the frame 20 terminate in spaced apart relationship so that, when the member 32 is loosely disposed within the eye means, they together provide pivot means along the lateral axis of member 32 about which frame 20 may be rotated.

Figure 4:
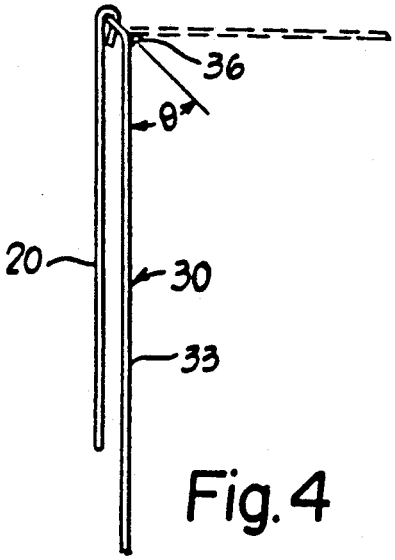
FIG. 4 is a side elevational view, with portions broken away, of the device in the upright position prior to positioning the holding frame for receiving a bag.
Figure 5:
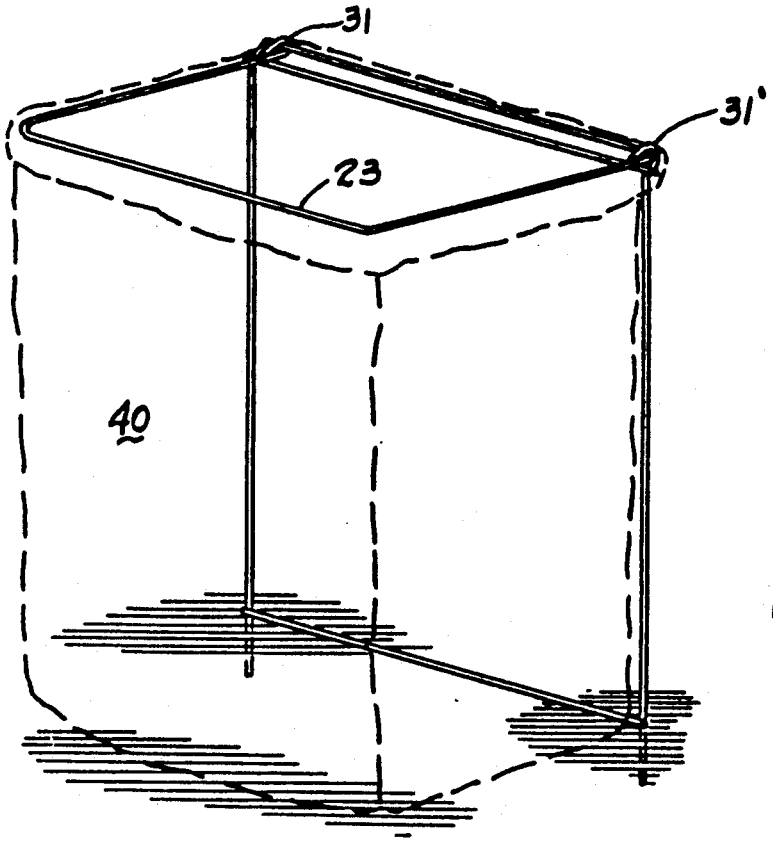
FIG. 5 is a perspective view of the device inserted into the earth so as to maintain an upright position, and showing a plastic bag, in phantom outline, snagged on the bag holding frame.
Figure 6:
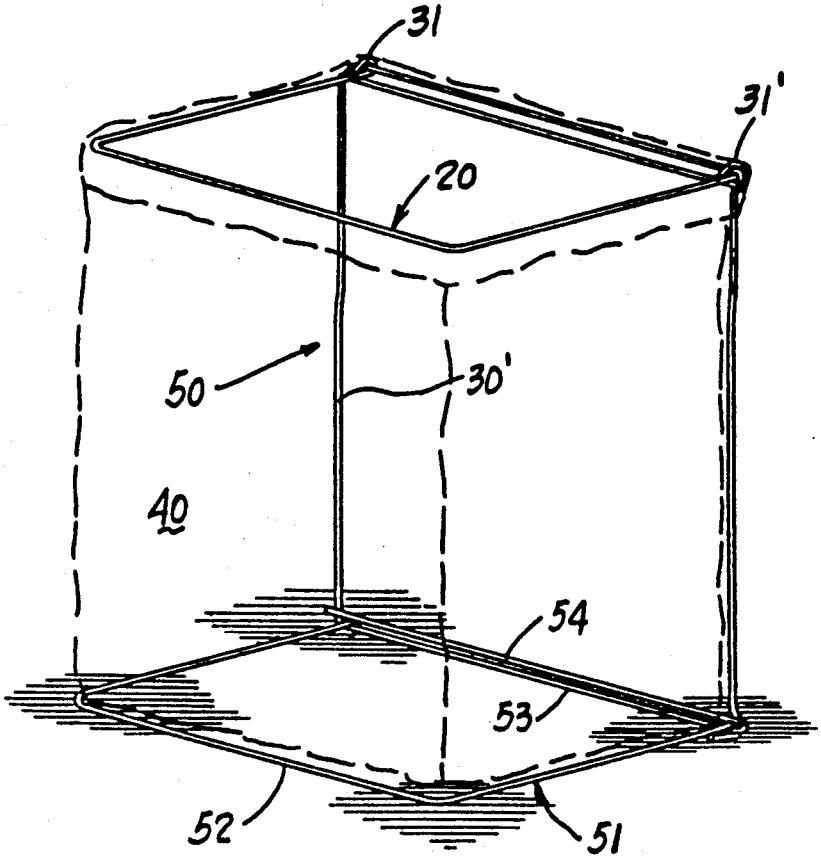
FIG. 6 is a perspective view of another embodiment of the invention including a base shown as a mirror image of the bag holding frame, which base serves to support the supporting framework for the bag holding frame.

The bag shown in phantom outline in FIGS. 5 and 6 will thus be held in a wire framework formed by side members 22 and 22', front member 23 and the uppermost member 32 when the bag holding frame 20 is supported in a horizontal position. The peripheral length of the wire framework, represented by the sum of the lengths of its individual members is chosen to match the periphery of the mouth of the plastic bag to be held in the framework. A precise match is not essential, provided it is close enough to permit the mouth of the bag, or the upper portion of the bag adjacent its mouth, to be draped or snagged at several points, that is at least three points on the wire framework. With the rectangular shape of the bag holding frame shown in FIGS. 1–9, four corners and numerous other such points are provided.

The sides 33 and 33' are long enough to allow the bottom of a plastic bag 40 (shown in phantom outline in FIG. 5) to rest on the ground when the stub means 34 and 34' of the sides are thrust to a predetermined depth into the ground. This depth is conveniently determined by a lateral stiffening strut 35 the ends of which are resistance-welded to the sides. Of course it is not essential, in order to hold the supporting frame in an upright position, that the stub means be inserted into the ground to their full depth, particularly if the ground is hard, but under normal circumstances, insertion to the predetermined depth will ensure that the supporting frame will not be laterally tilted in its upright position.

The horizontally supported position of the bag holding frame referred to hereinabove is made possible by a unique configuration of the upper portion of the supporting frame 30. As shown in FIG. 1, side 33 near its top, is bent away from the vertical at an angle of about 45° so that the lateral axis defined by the uppermost member 32 is offset from the vertical. A lateral support strut 36 is resistance-welded near its ends to the sides 33 and 33' respectively, adjacent the apex of the angle $\theta$, at a point which allows the bag holding frame to lie in a horizontal plane, generally parallel to the surface of the ground into which the stubs 34 and 34' are thrust. It will be appreciated that the precise relative positions of the member 32, the lateral support strut 36 and the bag holding frame will be a function of the thickness of the wire, the geometry of the wrap-around connection and the angle $\theta$, and will be derived with a little trial and error as one skilled in the art is accustomed to undertake.

When the bag holding frame is not used to hold a bag in a leaf or refuse-receiving position, and is to be stored, or shipped, it hangs from the uppermost member 32 in a vertical position adjacent the supporting frame 30 as seen in FIG. 4, though the bag holding frame and the lower portion of the supporting frame is shown broken away. To place the bag holding frame in service, it is simply rotated through an angle of 270° about the member 32, which serves as the pivot means along the lateral axis, until the bag holding frame comes to rest against the support strut 36, as shown by its (the frame's) phantom outline.

For wire having a diameter greater than 0.125" the angle $\theta$ may be slightly less than 45°, but in the embodiment of the invention in which a lateral support strut is used, member 32 is always offset away from the strut 36 by a short distance in the range from about 0.25" to about 0.75" sufficient to allow the requisite rotation of the bag holding frame and support it in a substantially horizontal position.

Referring now to FIG. 6 there is shown another embodiment indicated generally by reference numeral 50, of the invention which includes a base, indicated generally by reference numeral 51, which allows the supporting frame 30' to be supported in an upright position, when the device is to be used on hard surfaces such as concrete, wood decks and the like into which the stub ends of device 10 cannot conveniently be inserted. The base 51 is desirably fabricated as a U-shaped continuous single length of wire 52 the ends of which are bent downwards upon themselves so as to be wrapped-around a lowermost member 53 which serves as the lower pivot means, offset from the vertical in a manner analogous to that described hereinabove for uppermost member 32, so that the base may be rotated about a lateral axis defined by member 53, from a vertical position adjacent the plane of the supporting frame 30', to a horizontal position through an angle of about 270°. In the horizontal position, the supporting frame rest upon the base largely by virtue of lateral support strut 54. Thus, when the device 50 is ready for use it is seen that the bag holding frame 20 is essentially a mirror image of the base 51, or vice versa. As shown in FIG. 6 a bag 40 (shown in phantom outline) may be snagged on the wrap-around ends 31 and 31' and holding frame 20 and allowed to rest on the ground and base 51 while the bag is filled. After it is filled the bag may be removed by disengaging the mouth of the bag from the holding frame and removing the bag under the holding frame by a lateral force exerted in any generally forward or outward direction within an arc of about 180°. As an alternative, the bag is disengaged and the bag holding frame simply flipped out of the way, that is rotated so that it comes to rest in the vertical pendant position adjacent the supporting frame, and the bag lifted away.

It will be evident that it is not essential that the base and lower portion of the supporting frame be in mirror-image relationship with the holding frame and upper portion of the supporting frame. The function of the base will adequately be served by a planar loop formed from a single length of wire each end of which terminates in an eye means, adapted for rotational movement about a lower lateral axis along the lower portion of the supporting frame. Such a lower lateral axis is conveniently provided by a lower pivot means, for example a lateral wire member or loops in the lower ends of the sides of the supporting frame, in a manner analogous to that described for the upper potion of the wire holder.

Figure 7:
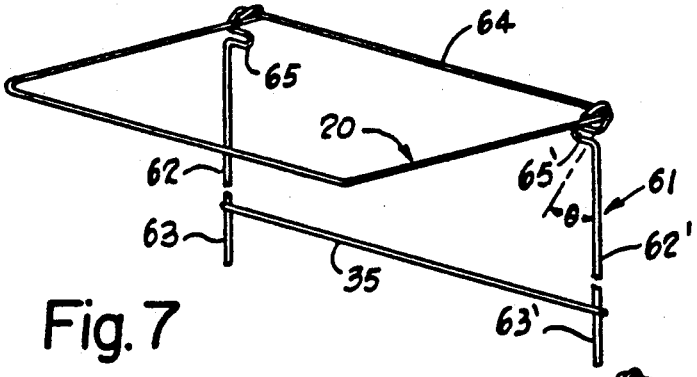
FIG. 7 is a perspective view of another embodiment of the invention, with the lower portion of the supporting framework broken away, showing a modification of the pivot means and wire stop means integrally formed in the supporting frame.

Referring to FIG. 7 there is shown another embodiment of the device, indicated generally by reference numeral 60, comprising a bag holding frame 20 and a supporting frame 61, portions of which are shown broken away, which is formed from a single continuous length of wire bent into a generally inverted U shape having sides 62 and 62'. A stiffening strut 35 is resistance-welded near its ends to the sides so as to leave stub ends 63 and 63' the ends of which may be pointed to facilitate their insertion into the ground. The sides 62 and 62' are interconnected by uppermost member 64 which is inclined upward and offset from the vertical plane in which sides 62 and 62' lie, in a manner analogous to the offset of member 32 in the device 10. Instead of a lateral support bar, there is provided a sideways ledge or U shaped tab 65 and 65' each projecting inwardly, on each of the sides 62 and 62', near their upper ends. As before, the ends of the holding frame are wrapped around the member 64 for rotation thereabout of the holding frame through an angle of 270°, so that it comes to rest on the upper portions of each of the ledge U shaped tabs, in a generally horizontal plane.

Figure 8A:
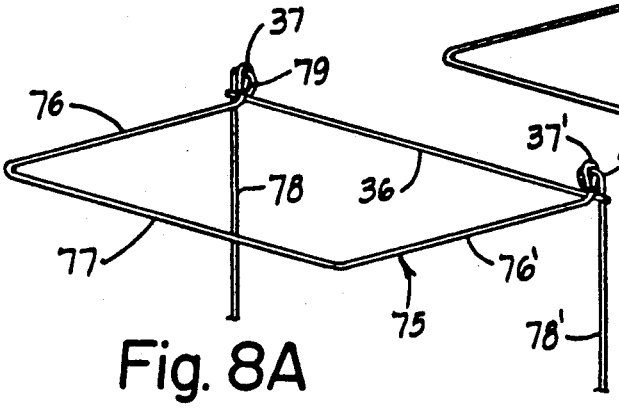
FIG. 8A is a perspective view, with the lower portion of the supporting frame broken away, illustrating loops at the top of each of the sides of the supporting frame, which loops serve as pivot means for the bag holding frame.
Figure 8:
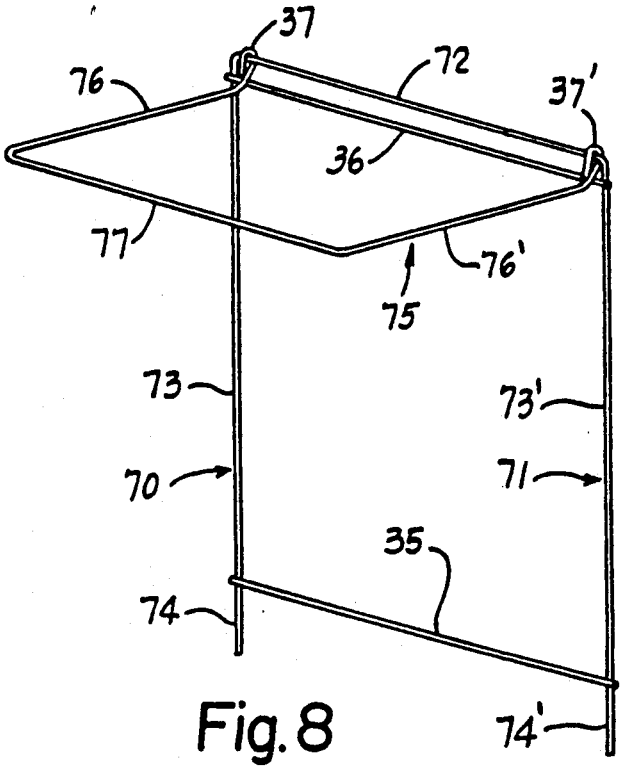
FIG. 8 is a perspective view of yet another embodiment of the invention showing a modification of the bag holding frame and upper portion of the supporting frame.

Referring now to FIG. 8 there is illustrated yet another embodiment of the device, indicated generally by reference numeral 70, having a bag holding frame 75 and a rectangular essentially planar supporting frame 71. As before, uppermost member 72 and sides 73 and 73' are formed from a single length of wire. Lateral support strut 36 is resistance-welded near its ends to the sides 73 and 73' near the member 72. Stiffening strut 35 is resistance-welded near the lower portions of the sides leaving stub ends 74 and 74' for insertion into the ground, and all wire members of the supporting frame are essentially coplanar.

The bag holding frame 75 is again formed from a single length of wire having sides 76 and 76' interconnected by front member 77 all of which are coplanar. The ends of sides 76 and 76' are inclined upward from the horizontal plane before they terminate in eye means 37 and 37' wrapped around the uppermost member 72 so that when the bag holding frame rests against the lateral support strut 36 the frame is in a horizontal position. As before, the mouth of the plastic bag to be filled is draped over the bag holding frame 75 and member 72, and the bag hangs with its bottom resting on the ground.

Referring to FIG. 8 there is diagrammatically illustrated another embodiment of the invention with the lower portion of the supporting frame's side members 78 and 78' broken away. The side members 78 and 78'are connected by stiffening strut 35 (not shown) as before to set the depth to which the stub ends of sides 78 and 78' are thrust into the ground. The sides 78 and 78' terminate at their upper ends in loops 79 and 79' around which eye means 37 and 37' of the bag holding frame 75 are wrapped. The loop 79 and 79' are formed in essentially the same plane as the supporting frame so that the eye means 37 and 37' are formed at the ends of upwardly inclined ends of sides 76 and 76' of the supporting frame, in a manner analogous to that described in FIG. 8 hereinabove. The lateral support strut 36, resistance-welded near the loops, is so positioned that the bag holding frame 75 is supported against the strut to lie in a horizontal plane. As before, the bag holding frame may be rotated to hang from the loops and lie adjacent the supporting frame in the vertical plane.

Referring to FIG. 8A there is illustrted a modification of the supporting frame shown in which loops 79 and 79' are provided at the tops of each of the sides 78 and 78' respectively, the loops being in the same plane as the sides 78 and 78'. The loops 78 and 78' are linked to the eye means 37 and 37' at the ends of the sides 76 and 76' of the bag holding frame 75. As described in FIG. 8 hereinabove, the eye means are formed at the ends of inclined end portions of the sides 76 and 76' the angle being selected to allow the bag holding frame to rest against the lateral support strut 36 in a horizontal position.

Figure 9:
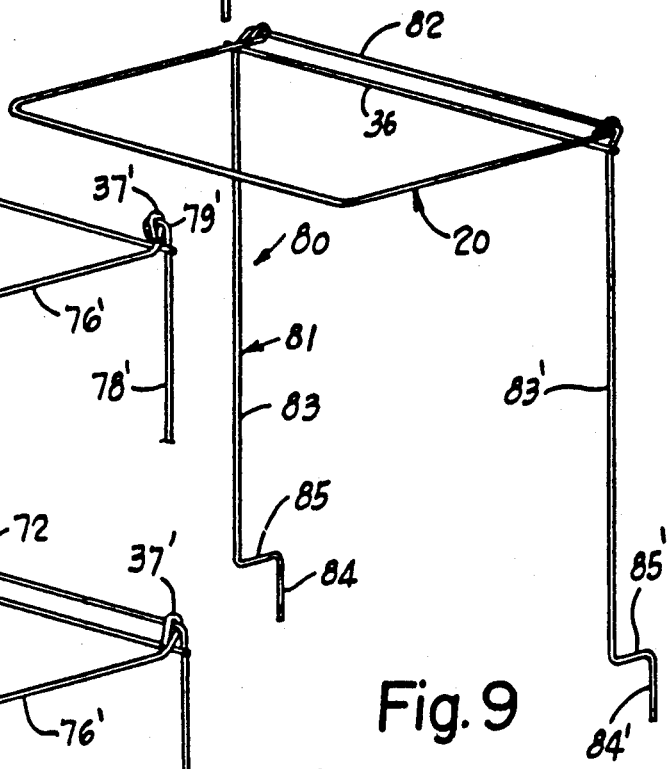
FIG. 9 is a perspective view of still another embodiment of the invention, showing the lower portion of the supporting frame for foot-assisted insertion into the ground.

Referring to FIG. 9 there is diagrammatically illustrated another embodiment indicated generally by reference numeral 80, of a device having a bag holding frame 20 and a supporting frame 81. The bag holding frame is similar to that used in device 10 and has wrap-around ends which are wrapped around uppermost member 82 which is inclined upward and offset from the plane in which sides 83 and 83' lie. Lateral support strut 36 is resistance-welded near its ends and serves the same function as it does in the embodiments described hereinbefore. The lower portions of the sides 83 and 83' are bent to provide Z-shaped bends the lower portions of which function as stub ends 84 and 84'. The horizontal portions of the Z-shaped bends provide lower lateral members which limit the depth to which the stubs may be inserted, and also provide support for a foot to facilitate insertion of the stub ends into the ground.

Figure 9A:
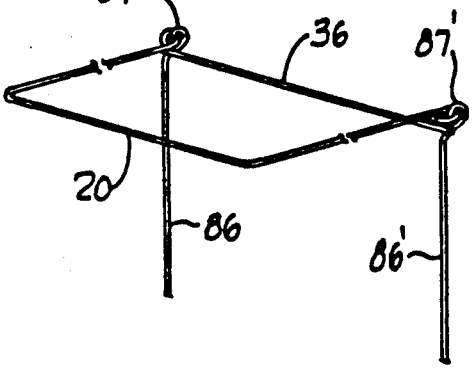
FIG. 9A is a perspective view with portions broken away, of a modification of the invention illustrated in FIG. 9 wherein the supporting frame includes loops at an angle from the vertical which loops provide pivot means in lieu of an uppermost member.

Referring to FIG. 9A there is illustrated a modification with portions broken away, of the embodiment illustrated in FIG. 9. Sides 86 and 86' of the supporting frame, formed from separate lengths of wire, at their upper ends, are bent away from the vertical so that the inclined portions 87 and 87' terminate in loops 79 and 79' around which eye means 31 and 31' are wrapped. The eye means are formed at the ends of the bag holding frame 20 which is formed in a manner analogous to that described for FIGS. 1–4. Lateral strut 36 is resistance-welded just below the vertex of the angle formed by the inclined portions 87 and 87' with the sides 83 and 83' respectively. If desired a stiffening strut 35 may also be welded to the sides, near their lower ends, to provide additional rigidity and strength to the supporting frame.

As stated hereinabove, the shape of the bag holding frame is not narrowly critical provided its peripheral length added to the length of the uppermost member of the supporting frame (the added lengths being the peripheral length of the wire framework holding the bag's mouth open) is about the same as the peripheral length of the mouth of the bag. For example, a typical large plastic trash bag has a mouth with a periphery of 62"; a wire framework with a peripheral length of about 62", whether 1" larger or smaller, will serve to provide several points on the wire framework upon which the bag may be draped to hold its mouth open. In general, for a large plastic bag and its holding frame, a match of peripheral lengths of the wire framework and the mouth of the bag within 2% is desirable.

Further, though as shown in FIG. 9, the wrap-around ends of the holding frame are out of and above the plane of the sides, they do not interfere with or negate the draping of the bag to hold its mouth open. In all embodiments, there is essentially no side-to-side mobility of the holding frame rotatably disposed on the uppermost member of the supporting frame. Thus, a filled bag may be removed from under the bag holding frame by freeing the mouth of the bag from the sides of the bag holding frame, then lifting it so it rotates about the lateral pivot means and comes to rest in a pendant position.

Figure 10:
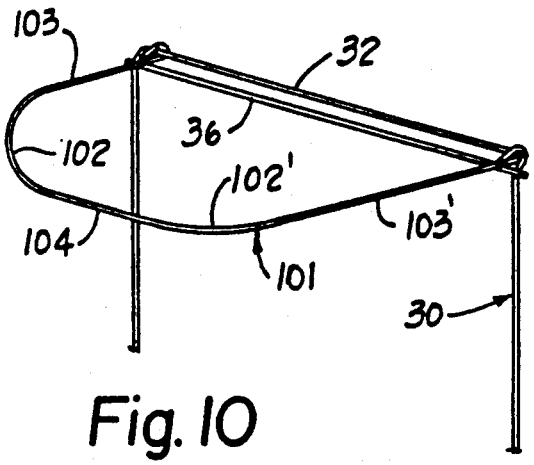
FIGS. 10–13 show modifications of the bag holding frame, in shapes other than rectangular, each with the same supporting frame structure.

FIGS. 10–13 illustrate various planar shapes of bag holding frames on a supporting frame having an offset and upwardly inclined uppermost lateral pivot member such as is shown in FIGS. 1–8. In FIG. 10 the bag holding frame 101 is formed in a C-shape which has relatively large radius front corners 102 and 102', approximately corresponding to the radius of the mouth of the bag, which corners serve effectively to shorten the linear portions of the sides 103 and 103' and the front member 104. The supporting frame 30 is shown with its lower portion broken away, and is the same as that shown in FIGS. 1–5.

Figure 11:
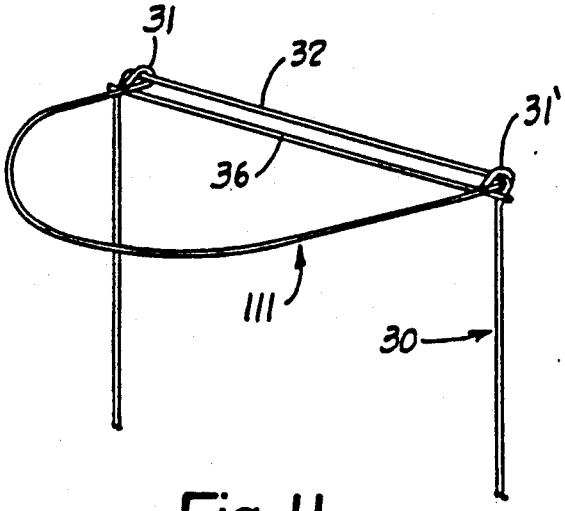

In FIG. 11 the bag holding frame 111 is formed as a semi-circle which provides a very large number of points at which the bag may be draped. As before, the supporting frame 30 is again shown with the bottom portion broken away.

Figure 12A:
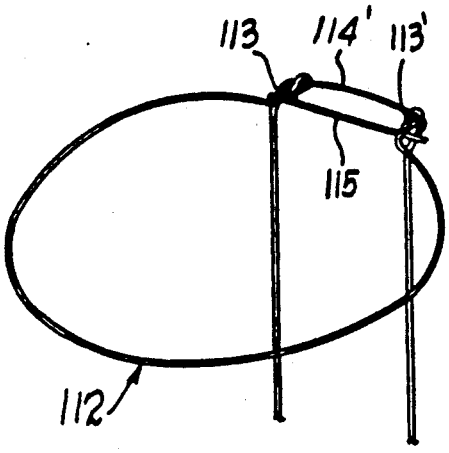
FIG. 12A is a perspective view with the lower portion of the supporting frame broken away, illustrating an arcuate uppermost member of the supporting frame which arcuate member serves as the pivot means.
Figure 12:
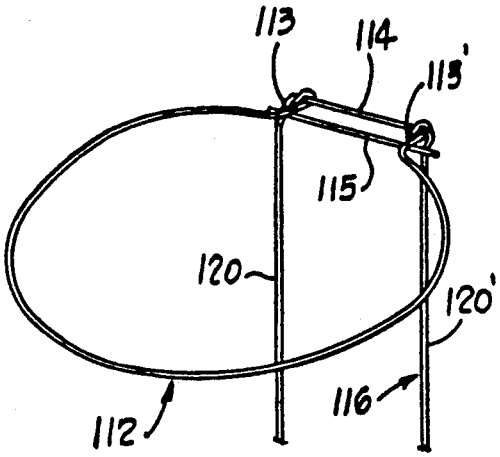

In FIG. 12 the bag holding frame 112 is formed essentially in the shape of a nearly complete circle, about three-fourths or more complete, with short sides 113 and 113' with wrap-around ends wrapped around a shortened uppermost member 114 offset and inclined upward from a lateral support strut 115 of about equal length with member 114, both of which form the upper portion of supporting frame 116 (lower portion broken away). The vertical sides 120 and 120' are of the supporting frame, the angulated wire portion at the top, between strut 115 and member 114, being at an angle $\theta$ as in FIG. 11.

In FIG. 12A there is illustrated a modification of the embodiment illustrated in FIG 12. In FIG. 12A the uppermost member 114' is arcuate, the ends of the arc terminating in upwardly inclined upper portions of the sides 120 and 120', the angle being sufficient to allow the bag holding frame to rest in a horizontal bag lading position.

Figure 13:
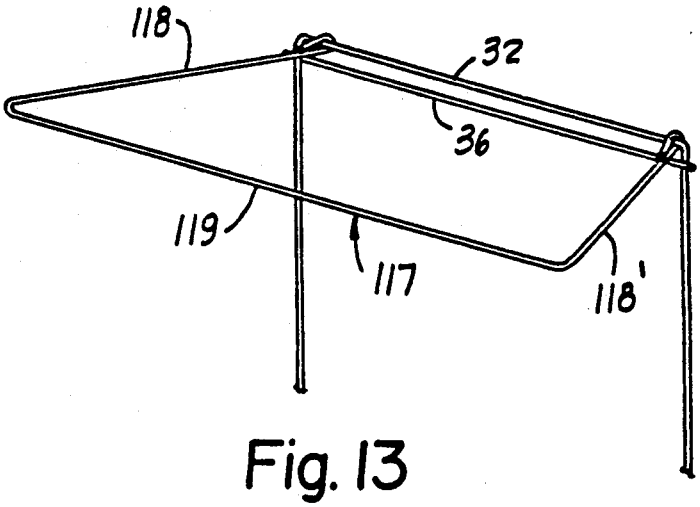

In FIG. 13 the bag holding frame 117 is trapezoidal, the sides 118 and 118' inclining inwardly from the front member 119, but in the same plane, and provided with eye means such as wrap-around ends adapted for rotational movement about the uppermost member of support frame 30.

In all the embodiments described hereinabove it will be noted that the bag holding frame is essentially planar despite the inclined end portions of the ends thereof in those embodiments where the supporting frame is coplanar. Thus, when the bag holding frame is hanging from the supporting frame, which is the configuration in which the assembly of bag holding frame and supporting frame is shipped, there is no projecting portion of the bag holding frame to complicate the packaging of the assembly.

Modifications, changes and improvements to the preferred forms of the invention herein disclosed, described and exemplified may occur to those skilled in the art who come to understand the principles and precepts thereof. Accordingly, the scope of the patent to be issued herein should not be limited to slavish adherence to the particular embodiments of the invention set forth herein, but rather should be limited by the advance of which the invention has promoted the art.

We claim:

1. A wire holder for a plastic bag for trash comprising a supporting frame, said supporting frame formed of a single piece of wire shaped generally into a "U" shape having a top portion intermediate two sides with said top portion being displaced in one direction in respect to the plane of the sides, a lateral support strut, said lateral support strut extending between said two sides affixed thereto generally parallel to and spaced from said top portion of said supporting frame, a stiffening strut, said stiffening strut extending between said two sides affixed thereto a spaced distance from the ends thereof, a bag holding frame, said bag holding frame formed of a single piece of wire shaped generally into a "U" shape having eyes formed in the ends thereof, said eyes of said bag holding frame loosely surrounding said top of said supporting frame so as to allow said bag holding frame to rotate substantially 270 degrees about said top from a storage position lying generally parallel to said sides of said supporting frame to a use position supported by the bottom edge of said top and the top edge of said lateral support strut to extend outwards of said supporting frame substantially perpendicular to said plane of said sides in a direction opposite from the direction said top is displaced in respect to the plane of the sides.

2. A wire holder for a plastic bag for trash comprising a supporting frame, said supporting frame formed of a single piece of wire shaped generally into a "U" shape having a top portion intermediate two sides with said top portion being displaced in one direction in respect to the plane of the sides, each of said sides having an inwardly extending sideways shaped ledge formed therein an equal distance from said top portion of said supporting frame, a stiffening strut, said stiffening strut extending between said two sides affixed thereto a spaced distance from the ends thereof, a bag holding frame, said bag holding frame formed of a single piece of wire shaped generally into a "U" shape having eyes formed in the ends thereof, said eyes of said bag holding frame loosely surrounding said top of said supporting frame so as to allow said bag holding frame to rotate about said top from a storage position lying generally parallel to said sides of said supporting frame to a use position supported by the bottom edge of said top and the top edge of said inwardly extending sideways-shaped ledge to extend outwards of said supporting frame substantially perpendicular to said plane of said sides in a direction opposite from the direction said top is displaced in respect to the plane of the sides with said eyes of said bag holding frame being movable together so as to allow said bag holding frame to selectively bypass said inwardly extending sideways shaped tab of said sides to rotate 360 degress about said top of said supporting frame.

* * * * *